United States Patent [19]

Doi

[11] Patent Number: 4,880,127

[45] Date of Patent: Nov. 14, 1989

[54] COMPOSITE VESSEL LID

[75] Inventor: Kouichi Doi, Hiratsuka, Japan

[73] Assignee: Japan Crown Cork Co., Ltd., Tokyo, Japan

[21] Appl. No.: 318,405

[22] Filed: Mar. 3, 1989

[30] Foreign Application Priority Data

Mar. 4, 1988 [JP] Japan ..... 63-49567

[51] Int. Cl.[4] ..... B65D 51/16

[52] U.S. Cl. ..... 215/252; 215/276; 215/307

[58] Field of Search ..... 215/276, 274, 260, 307, 215/252; 220/319, 367

[56] References Cited

U.S. PATENT DOCUMENTS 3,967,746 7/1976 Botkin ..... 215/260
4,121,729 10/1978 Husum ..... 215/276
4,565,295 1/1986 Mori et al. ..... 215/252
4,705,183 11/1987 Moloney ..... 215/276
4,749,094 6/1988 Fuchs ..... 215/252
4,813,561 3/1989 Ochs ..... 215/276 X

*Primary Examiner*—Donald F. Norton
*Attorney, Agent, or Firm*—Sughrue, Mion, Zinn, Macpeak & Seas

[57] ABSTRACT

Disclosed is a composite vessel lid comprising an outer lid of a plastic material to be engage with a neck of a vessel and an inner lid of a thin metal sheet held within the outer lid. Fine projections are formed at predetermined intervals in the abutting portion between the outer and inner lids, and a gas-releasing path is formed among the fine projections.

Since the gas-releasing path is not formed in a portion engaging with a vessel, such as a screwed portion of the outer lid, the engaging force is not reduced and the strength of the outer lid is not reduced, and release of gas is promptly accomplished effectively at the initial stage of opening.

5 Claims, 3 Drawing Sheets

Fig. 1-A
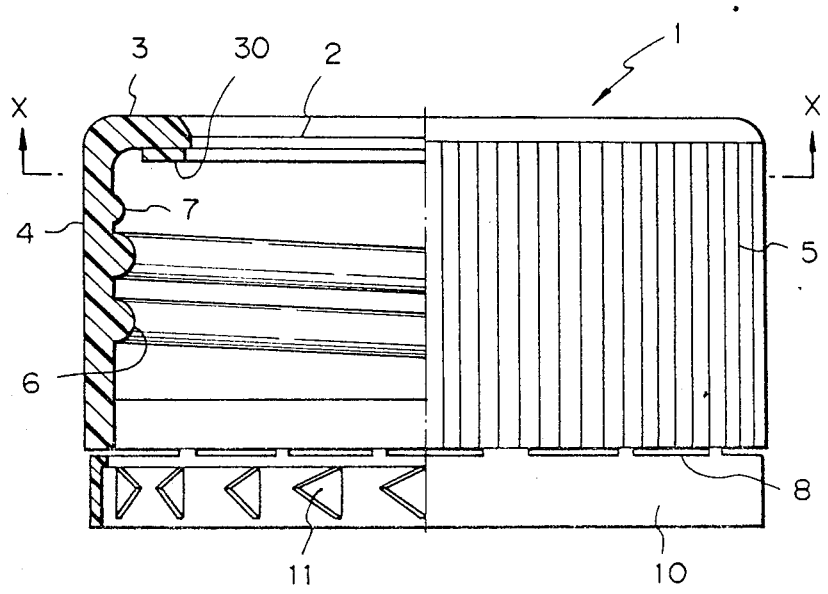
Fig. 1-B
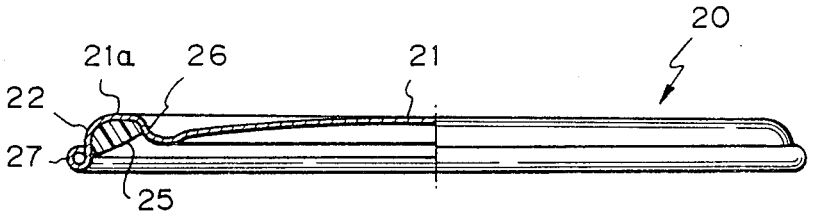

COMPOSITE VESSEL LID

BACKGROUND OF THE INVENTION (1) Field of the Invention

The present invention relates to a composite vessel lid comprising an outer lid and an inner lid in combination.

(2) Description of the Related Art

A composite vessel lid comprising an outer lid including an annular top panel wall having an opening in the central portion, a cylindrical skirt hanging down from the peripheral edge of the top panel wall, holding projections formed on the inner circumferential surface of the skirt and a screwed portion formed in the lower portion of the outer lid and adapted to engage with a neck of a vessel, and an inner lid of a thin metal sheet held on the inner side of the outer lid by said holding projections is known.

In the composite vessel lid this type, the outer lid in which the screwed portion is formed is composed of a plastic material, and the inner lid is composed of a metal. Accordingly, this composite vessel has merits of both the metal cup and plastic cup.

However, problems arise when this vessel lid used for sealing a content having an autogeneous pressure, such as a carbonated drink.

More specifically, in a vessel lid used for sealing a content having an autogeneous pressure, such as a carbonated drink, if the inner pressure is not released at the initial stage of opening, spouting of the content is caused at the time of opening, or the vessel lid per se is blown off. This trouble is especially conspicuous in case of a lid having a screwed portion composed of a plastic material.

For example, in case of a combination of a vessel lid formed of a metal and a glass bottle, screws of both the members have a rigidity, and even at the initial stage of opening, a vent passage for releasing the inner pressure through the space between the screws is easily formed. However, if the screwed portion is formed of a plastic material, since the screw per se has certain compressibility and deformability, even at the stage where opening is advanced to some extent by turning of the vessel lid, air tightness is still maintained between the screw of the lid and the screw of the vessel and a vent passage is hardly formed.

As means for solving this problem, there is known a method in which a vent hole is formed in a side wall between a sealed portion and a screw for releasing the inner pressure at the initial stage of opening (see Japanese Patent Publication No. 30266/81).

This vent hole can formed relatively easily in case of a metal lid having excellent processability and machinability, but in the case where the screwed portion is formed of a plastic material, formation of a vent hole after the molding is difficult, and if it is intended to form a vent passage simultaneously with the molding, removal of the formed lid from a mold becomes difficult. Moreover, the strength of the screwed portion is reduced.

SUMMARY OF THE INVENTION

It is therefore a primary object of the present invention to provide a composite vessel lid in which a vent hole can easily be formed without reduction of the strength or other defect.

More specifically, in accordance with the present invention, there is provided a composite vessel lid comprising an outer lid of a plastic material including an annular top panel wall having an opening in the central portion. a cylindrical skirt hanging down from the peripheral edge of the top panel wall, holding projections formed on the inner circumferential surface of the skirt and a screwed portion formed in the lower portion of the outer lid and adapted to engage with a neck of a vessel, and an inner lid of a thin metal sheet held on the inner side of the outer lid by said holding injections, wherein on the inner side of the top panel wall, fine projections are formed at predetermined intervals at least in a portion to be fitted with the inner lid at the time of sealing of the vessel lid.

BRIEF DESCRIPTION OF THE DRAWINGS

FIGS. 1-A and 1-B are diagrams illustrating the outer and inner lids used for the composite vessel lid of the present invention, respectively.

DETAILED DESCRIPTION OF THE INVENTION

Figure 2:
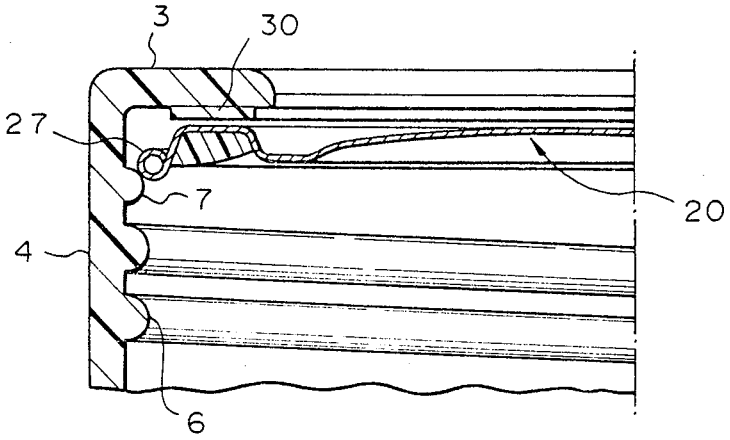
FIG. 2 is diagram illustrating the structure of the composite vessel lid of the present invention.

In the composite vessel lid of the present invention, a vent passage is formed by the abovementioned fine projections.

More specifically, in the state where the composite vessel lid is engaged with a mouth of a vessel, the outer surface of the inner lid composed of a metal abuts against the top ends of the projections, and a gas-releasing passage is always formed among the fine projections between the inner side of the top panel wall of the outer lid and the outer surface of the inner lid.

The inner lid is lightly held by the holding projections formed on the outer lid, so that the inner lid is not isolated from the outer lid.

Accordingly, when the vessel lid is opened, a gas flow path is formed at the point of release of sealing between the inner lid and the interior of the vessel, irrespectively of the degree of the screw engagement.

Therefore, according to the present invention, release of gas is promptly accomplished at the initial stage of opening.

The present invention will now be described in detail with reference to an embodiment illustrated in the accompanying drawings.

Referring to FIG. 1-A showing the outer lid used for the composite vessel lid of the present invention, an outer lid represented as a whole by reference numeral 1 comprises an annular top panel wall 3 having an opening 2 formed in the central portion and a cylindrical skirt 4 hanging down from the peripheral edge of the top panel wall 3.

The top panel wall 3 and cylindrical skirt 4 are integrally molded by injection molding or the like of a plastic material.

A knurled groove 5 is formed on the outer surface of the cylindrical skirt for facilitating holding and turning by the fingers, and a screwed portion 6 and holding projections 7 projecting inwardly with respect to the radial direction at predetermined intervals are formed on the inner surface of the skirt 4.

A known pilfer-proof mechanism may be formed on the outer lid, and in the present embodiment, this mechanism comprises a narrow annular pieced 10 connected to the lower end of the skirt 4 through a circular perforated weakened line 8. Many plastic pieces 11 to be engaged with a jaw portion of the vessel are formed on the inner surface of the annular piece 10 at a certain inward inclination angle.

Referring to FIG. 1-B illustrating the inner lid used for the composite vessel lid of the present invention, an inner lid represented as a whole by reference numeral 20 comprises a circular top panel wall 21 and a hem 22 hanging down by a small distance from a peripheral edge 21*a* of the top panel wall 21.

The inner lid 20 is formed by press molding of a metal sheet such as a tinplate sheet or a chrome-treated steel sheet.

In this inner lid 20, a liner 25 is arranged on the inner side of the peripheral edge 21*a* so that good sealing is attained between the inner lid 20 and the mouth portion of the vessel. Namely, in the composite vessel lid, the inner side portion of the peripheral edge 21*a* of the lid 20 abuts against the top end of the mouth portion of the vessel to effect sealing.

A step is formed on the peripheral edge 21*a* on the inner side with respect to the radial direction, and the top panel wall 21 has a curved shape projecting upwardly to the central portion from the step 26.

By dint of this curved shape of the top panel wall 21, the inner pressure of the content in the vessel can be moderated.

A curl 27 is formed at the lower end of the hem 22, if necessary, whereby effective engagement with the holding projections 7 of the outer lid 1 is attained.

The composite vessel lid comprising the abovementioned outer lid 1 and inner lid 20 in combination is shown in FIG. 2.

Namely, in the composite vessel lid of the present invention, the inner lid 20 is supported by the holding projections 7 within the outer lid 1 to completely close the central opening 2 of the outer lid 1.

In this case, the inner lid 20 is held within the outer lid 1 by the engagement between the curl 27 formed at the lower end of the hem 22 and the holding projections 7. However, it is sufficient if the inner lid 20 is held to such an extent that the inner lid 20 is not isolated from the outer lid 1, and it is not necessary to form sealing engagement by close adhesion of the curl 27 to the inner wall of the skirt 4 of the outer lid 1. If this sealing engagement is formed, at the time of opening of the vessel lid, a gas flow path described hereinafter is not formed and it is difficult to attain the object of the present invention.

Figure 3:
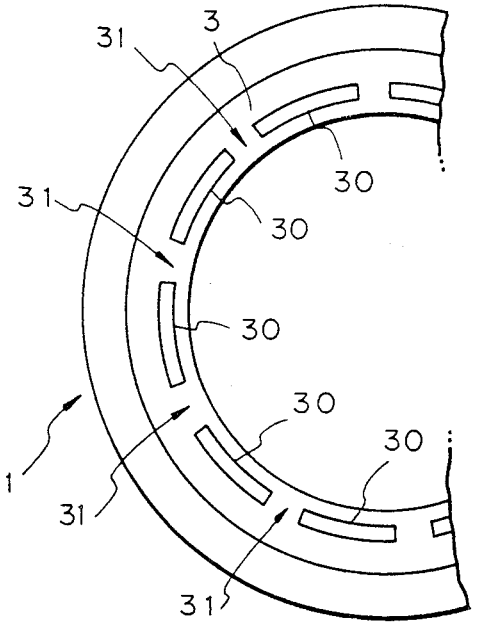
FIG. 3 is a plane view illustrating the outer lid shown in FIG. 1-A.

In the present invention, fine projections 30 are formed at predetermined intervals on the inner side of the annular top panel wall 3 of the outer lid 1 (see FIG. 3 showing the section taken along the line X—X in FIG. 1-A).

More specifically, in the case where the composite vessel lid of the present invention is used in the state where the composite vessel lid is engaged with the mouth portion of the vessel, sealing is effected between the inner lid 20 and the top end of the mouth portion of the vessel, and the above-mentioned fine projections 30 formed on the annular top panel wall 3 of the outer lid 1 abut against the outer surface of the peripheral edge 21*a* of the inner lid 20, whereby the inner lid 20 is positioned and fixed onto the mouth portion of the vessel.

Accordingly, it will be understood that a gas path 31 is always formed among the projections 30 in this state.

Figure 4:
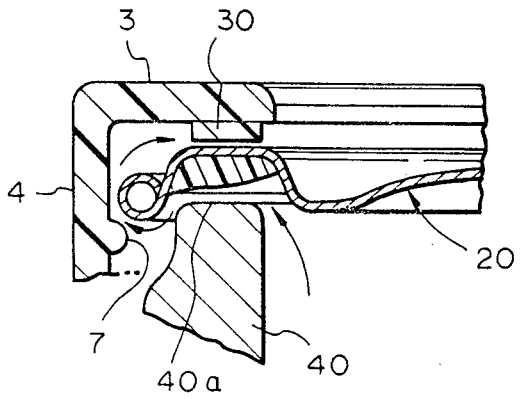
FIG. 4 is a view showing the state of engagement between the composite vessel lid of the present invention and a mouth portion of a vessel.

If this vessel lid is opened, referring to FIG. 4 illustrating the engagement state between the vessel lid and the mouth portion of the vessel, sealing between the inner lid 20 and the top end 40*a* of the mouth portion 40 of the vessel is released, irrespectively of the degree of the screwing engagement between the outer lid 1 and the mouth portion 40 of the vessel, and simultaneously, a gas flow path as indicated by arrows in FIG. 4 is formed.

Accordingly, in the composite vessel lid of the present invention, release of gas is promptly accomplished at the initial stage of opening.

In the present invention having the above-mentioned structure, the fine projections 30 to be arranged on the inner side of the annular top panel wall 3 of the outer lid 1 can be molded simultaneously with molding of the outer lid 1, or there may be adopted a method in which a ring having projections arranged at predetermined intervals is formed and this ring arranged on the inner side of the annular top panel wall 3.

As is apparent from the foregoing description, even in the case where the composite vessel wall is used for sealing a content having an autogeneous, such as a carbonated drink, release of gas is effectively accomplished at the initial stage of opening, and occurrence of troubles at the time of opening, such as spouting of the content and blow-off of the vessel lid, can be prevented.

Furthermore, in the present invention, since the gas flow path is not formed in the screwed portion, such problems as reduction of the strength of the screwed portion and reduction of the sealing property, do not arise. Moreover, the composite vessel lid of the present invention can be manufactured very easily.

I claim:

1. A composite vessel lid comprising an outer lid of a plastic material including an annular top panel wall having an opening in the central portion, a cylindrical skirt hanging down from the. peripheral edge of the top panel wall, holding projections formed on the inner circumferential surface of the skirt and a screwed portion formed in the lower portion of the outer lid and adapted to engage with a neck of a vessel, and an inner 10 lid of a thin metal sheet held on the inner side of the outer lid by said holding injections, wherein on the inner side of the top panel wall, fine projections are formed at predetermined intervals at least in a portion to be fitted with the inner lid at the time of sealing of the vessel lid.

2. A composite vessel lid as set forth in claim 1, wherein a gas-releasing passage is formed among the fine projections.

3. A composite vessel lid as set forth in claim 1, wherein the fine projections are formed integrally with the outer lid of a plastic material.

4. A composite vessel lid as set forth in claim 1, wherein a pilfer-proof mechanism is formed on the outer lid.

5. A composite vessel lid as set forth in claim 4, wherein the pilfer-proof mechanism comprises an annular piece connected to the lower end of the skirt through a perforated weakened line.

* * * * *